US010221607B2

(12) United States Patent
Gramstad

(10) Patent No.: US 10,221,607 B2
(45) Date of Patent: Mar. 5, 2019

(54) INTEGRATED CASEMENT WINDOW OPERATOR AND LOCK

(71) Applicant: Truth Hardware Corporation, Owatonna, MN (US)

(72) Inventor: Derek Ronald Gramstad, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 110 days.

(21) Appl. No.: 15/403,466

(22) Filed: Jan. 11, 2017

(65) Prior Publication Data

US 2017/0198512 A1 Jul. 13, 2017

Related U.S. Application Data

(60) Provisional application No. 62/277,337, filed on Jan. 11, 2016.

(51) Int. Cl.

| | |
|---|---|
| ***E05F 11/14*** | (2006.01) |
| ***E05F 11/12*** | (2006.01) |
| ***E05C 9/14*** | (2006.01) |
| ***E05C 1/12*** | (2006.01) |
| ***E05F 11/10*** | (2006.01) |
| ***E05C 17/04*** | (2006.01) |
| ***E05C 9/12*** | (2006.01) |

(52) U.S. Cl.

CPC ..... *E05F 11/145* (2013.01); *E05C 1/12* (2013.01); *E05C 9/12* (2013.01); *E05C 9/14* (2013.01); *E05C 17/04* (2013.01); *E05F 11/10* (2013.01); *E05F 11/12* (2013.01); *E05F 11/14* (2013.01)

(58) Field of Classification Search

CPC ..... E05F 11/145; E05F 11/12; E05F 11/14; E05F 11/16; E05F 11/10; E05C 9/12; E05C 9/14

See application file for complete search history.

(56) References Cited

U.S. PATENT DOCUMENTS

| | | | | | |
|---|---|---|---|---|---|
| 5,839,229 | A * | 11/1998 | Briggs | E05F 11/14 | 49/246 |
| 6,076,304 | A * | 6/2000 | Carrier | E05C 9/021 | 49/336 |
| 6,122,863 | A * | 9/2000 | Tippin | E05F 11/16 | 49/279 |
| 9,790,726 | B2 * | 10/2017 | Balbo di Vinadio | E05F 11/16 | |
| 9,797,176 | B2 * | 10/2017 | Balbo Di Vinadio | E05F 11/14 | |
| 9,957,740 | B2 * | 5/2018 | Goetze | E05C 9/16 | |
| 2017/0306682 | A1 * | 10/2017 | McInnis | E05F 15/622 | |

FOREIGN PATENT DOCUMENTS

| | | | | |
|---|---|---|---|---|
| CA | 2360634 | A1 * | 4/2003 | E05C 9/02 |
| CA | 2460464 | A1 * | 9/2005 | E05F 11/10 |
| JP | 2002220969 | A * | 8/2002 | E05F 11/16 |

* cited by examiner

*Primary Examiner* — Marcus Menezes
(74) *Attorney, Agent, or Firm* — Patterson Thuente Pedersen, P.A.

(57) ABSTRACT

An integrated casement window operator and lock mechanism including an arm shiftable with a lever handle between a first position of the lever handle wherein the window is closed and the sash is locked to the frame with a hook defined in an arm of the operator and lock mechanism, a second position wherein the hook is disengaged so as to unlock the sash from the frame, and a third position wherein the arm is pivoted outward to move the sash out of the frame, thereby opening the window.

18 Claims, 9 Drawing Sheets

INTEGRATED CASEMENT WINDOW OPERATOR AND LOCK

CROSS-REFERENCE TO RELATED APPLICATION

The present application claims the benefit of U.S. Provisional Application No. 62/277,337, filed Jan. 11, 2016, which is hereby incorporated herein in its entirety by reference.

TECHNICAL FIELD

The instant invention relates to casement windows, and in particular operators and locks for casement windows.

BACKGROUND OF THE INVENTION

A casement window is a window that has a sash attached to a frame with hinges so that the sash can swing in and out to close or open the opening defined by the frame. Casement windows have certain advantages over sliding windows, such as double-hung or sideways sliding windows. In particular, sliding windows can be difficult to seal against air infiltration, since the sash must slide against the air sealing gasket or weatherstripping. This often means that the sliding sash is not fitted as tightly, and the materials used for sealing selected so as to avoid excessive friction and wear. Casement sashes, however, can swing into contact with the seal, thereby avoiding any friction and causing minimal wear of the seal.

A drawback of casement windows, however, is that an operator typically must be used. An example of a typical operator used with a casement is disclosed in U.S. Pat. No. 7,464,619, said patent being hereby fully incorporated herein by reference. Such complex operators add expense and complexity to the window. Further, casement windows typically have separate locking systems to provide security against unauthorized access. These systems can add complexity to window operation as well as expense. These factors have led to casement windows being used less frequently in low-cost construction.

What is needed in the industry is a simple casement operator that integrates the locking function in one device.

SUMMARY OF THE INVENTION

Embodiments of the present invention meet the need in the industry for a simple casement operator that integrates the locking function in one device.

According to embodiments of the invention, an operator device may be mounted on the jamb of the window frame on the opening side of the window, similar to traditional casement locks as depicted in FIG. 1. The operator is designed so that a cover and handle can be applied after the operator is mounted to the frame. The operator has access to the drive spline from both the left and right sides, as depicted in FIG. 2 and FIG. 3. This enables the device, handle, and cover to be used on both right and left hand windows.

The operator has two segments of motion. During a first segment, the handle is shifted from a downwardly folded position to a midpoint position thereby translating an arm downward (depicted in FIG. 4 and FIG. 5), and disengaging a lock feature integrated into the drive arm from a lug attached to the window frame integrated into the mounting plate as well as pulling a multi-point lock tie bar (FIG. 7 and FIG. 8). The downward travel is the typical motion for unlocking casement windows, which retains consistency between this and traditional locks.

In the second motion, when the handle is shifted from the midpoint until it is upwardly folded, the arm rotates outwardly from the frame (FIG. 6). The arm is connected to a sash interface with a clip that can be disconnected for egress use. The sash interface includes a shoe runs along a track mounted to the sash. The outward projection of the arm causes the sash to open.

The mechanics of the operator enable it to reduce the number of components necessary to achieve the motion for unlocking and then opening the sash. It has a straight section of gear teeth on the arm that accomplish the unlocking function while leaving the sash closed. The gear teeth on the arm then transition to a curved section that causes the arm to rotate, resulting in the sash opening.

Embodiments of the invention may offer some or all of the following differences and advantages when compared with prior systems:

- The operator as an integrated single point lock—for small windows this may be all the locking needed.
- For larger windows this operator can be connected with existing multi-point lock tie bar systems for additional locking capability.
- The operator is symmetrical about its plane of operation allowing the device to be used for both left and right opening windows.
- The operator has a spline input for the handle on both the left and right side allowing the same handle and cover to be used for a left and right hand version.
- The drive system is accomplished from two gear segments; the first a standard round spur gear, the second a combination of a rack that transitions into an arc section of spur gear.
- The drive system is created by using a standard round spur gear and a drive arm that has a section of rack gear that transitions into round spur gearing. The rack section creates the linear travel needed to drive the lock/unlocking function and the round spur gear section allows for the rotation of the arm to open the window.
- The connection between the drive arm and the tie bar is a link that can pivot allowing for variation in the position of the tie bar with relation to the face of the frame.

As such, according to embodiments of the invention, an integrated casement window operator and lock includes a gear mechanism, the gear mechanism including a housing, a pinion gear rotatably mounted to the housing, and an arm assembly including an arm and a sash interface, the arm defining a rack portion and an adjacent arcuate gear portion, the arm slidably and rotatably mounted to the housing with the pinion gear engaged with the rack portion and the arcuate gear portion, the arm further defining a hook portion, the sash interface including a track and a shoe slidably coupled with the track, a distal end of the arm pivotally coupled with the shoe, and a handle operably coupled with the pinion gear. With the housing of the gear mechanism adapted to be mounted on a frame of a casement window, and the track of the gear mechanism adapted to be mounted on a sash of the casement window, the handle is selectively movable to rotate the pinion gear such that the arm is shifted between a first window locked position wherein the sash of the casement window is received in the frame of the casement window and the hook portion is engaged with a lug attached to the frame of the casement window so as to retain the sash in engagement with the frame, a second window unlocked position wherein the arm is shifted relative to the housing such that the hook is free from engagement with the lug, and a third sash open position wherein the arm is rotated relative to the housing urging the sash to be swung outward from the frame. The rack portion and the arcuate gear portion may be defined on an edge of the arm. The housing can define a guide slot, with the arm having a pin, the pin slidably received in the guide slot. The guide slot may have a straight portion and an arcuate portion. In embodiments of the invention, the arm is operably coupled to a tie bar slidably mounted to the frame of the casement window. The tie bar can include at least one lug, and at least one corresponding keeper is attached to the sash, the tie bar being selectively shiftable with the handle such that the at least one lug of the tie bar is engaged with the at least one corresponding keeper in the window locked position, and the at least one lug of the tie bar is free from the at least one corresponding keeper in the window unlocked position. cover.

In embodiments of the invention, the handle is engageable with the pinion gear in at least two different orientations so as to accommodate left-handed and right-handed mounting.

The first window locked position may correspond to a first position of the handle, the second window unlocked position can correspond to a second position of the handle, and the third sash open position can correspond to a third position of the handle.

In another embodiment of the invention, a casement window includes a frame defining an opening, a sash received in the frame and hinged to the frame to selectively close the opening, and a window operator and lock. The window operator and lock can include a gear mechanism, the gear mechanism including a housing, a pinion gear rotatably mounted to the housing, and an arm assembly including an arm and a sash interface, the arm defining a rack portion and an adjacent arcuate gear portion, the arm slidably and rotatably mounted to the housing with the pinion gear engaged with the rack portion and the arcuate gear portion, the arm further defining a hook portion, the sash interface including a track and a shoe slidably coupled with the track, a distal end of the arm pivotally coupled with the shoe, and a handle operably coupled with the pinion gear. The housing of the gear mechanism is mounted to a frame of the casement window, and the track of the gear mechanism is mounted to the sash of the casement window. The handle is selectively movable to rotate the pinion gear such that the arm is shifted between a first window locked position wherein the sash of the casement window is received in the frame of the casement window to close the opening and the hook portion is engaged with a lug attached to the frame of the casement window so as to retain the sash in engagement with the frame, a second window unlocked position wherein the arm is shifted relative to the housing such that the hook is free from engagement with the lug, and a third sash open position wherein the arm is rotated relative to the housing urging the sash to be swung outward from the frame.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
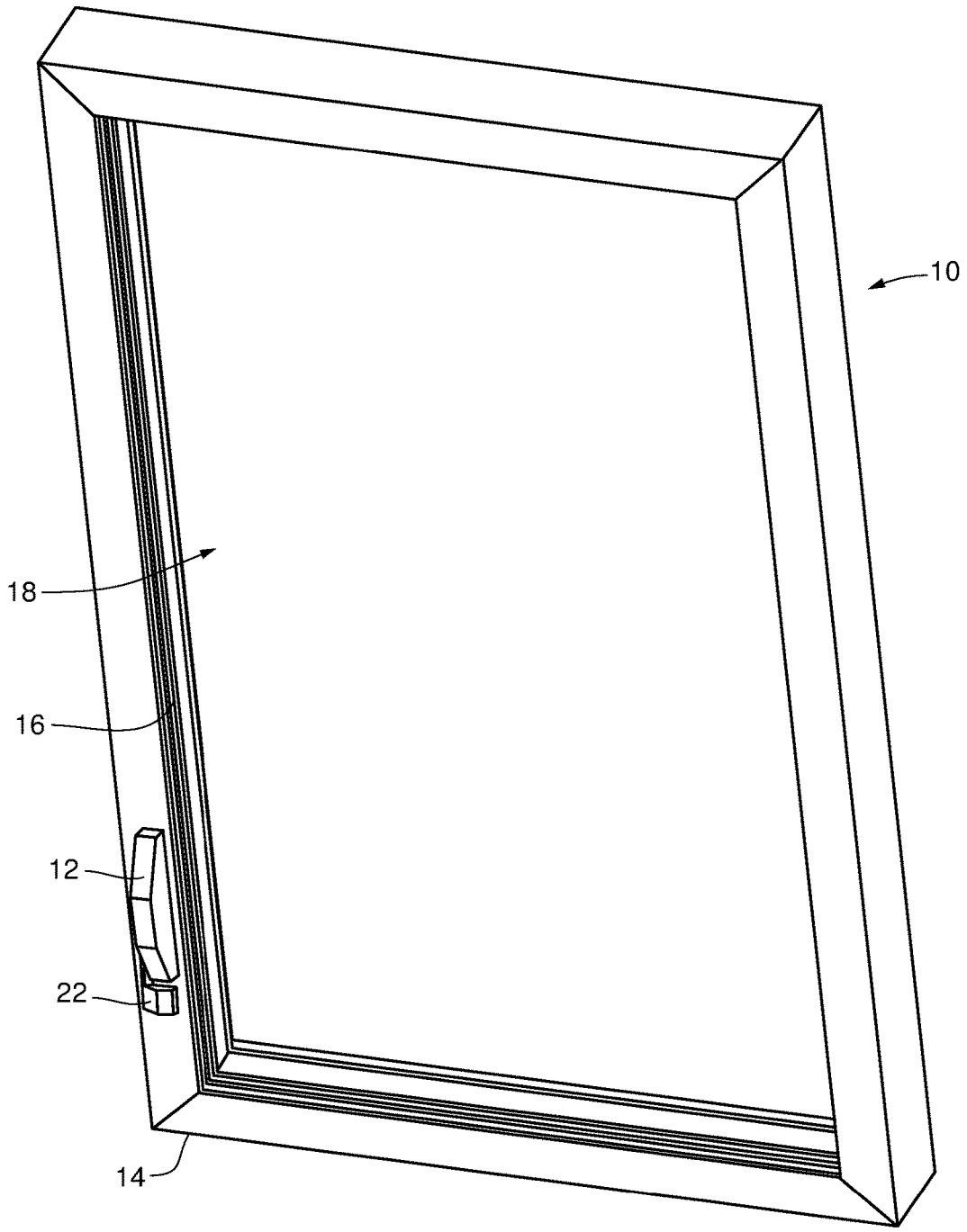
FIG. 1 depicts a casement window with an integrated window operator and lock according to an embodiment of the invention.
Figure 2:
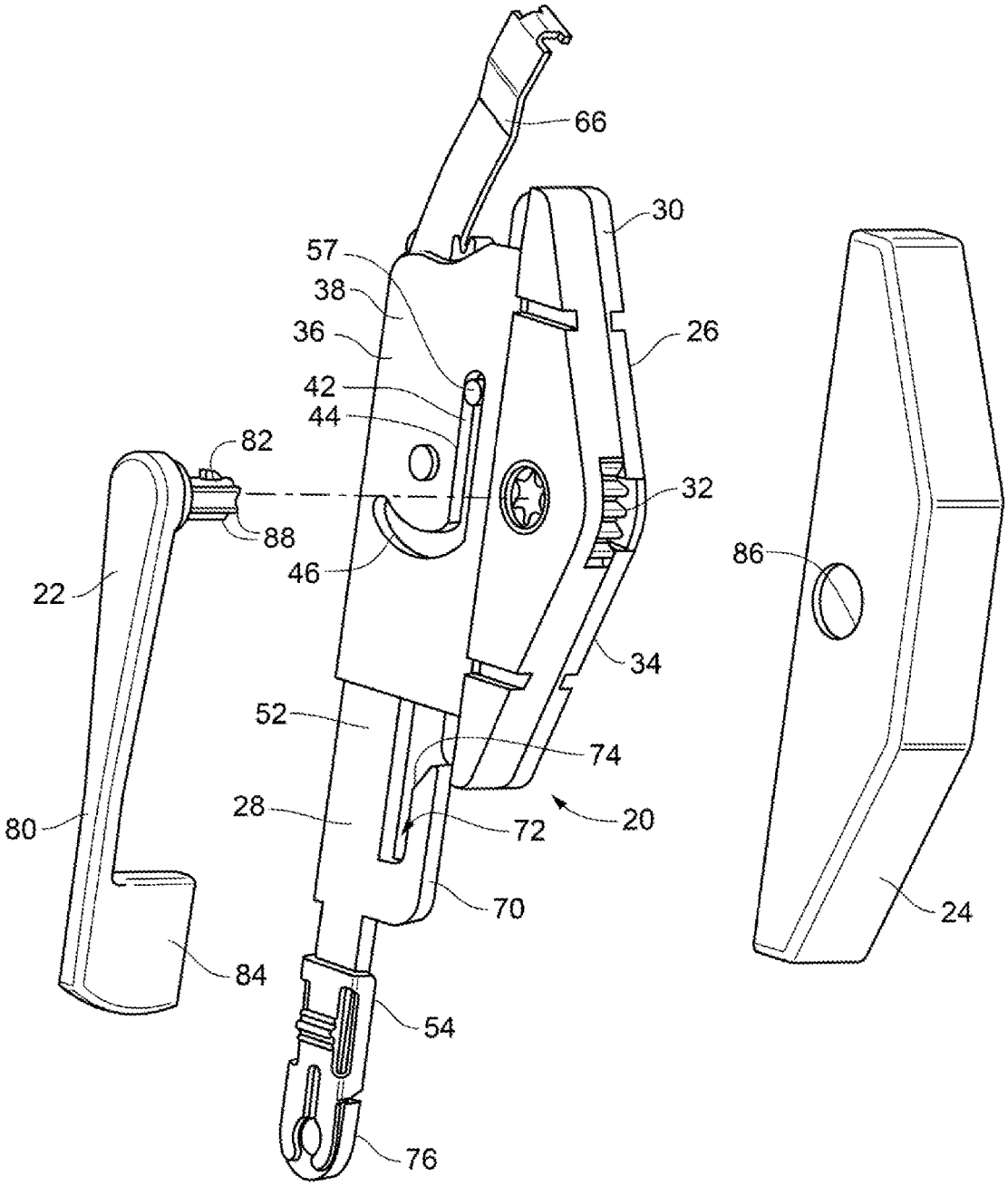
FIG. 2 is an exploded isometric view of an integrated window operator and lock according to an embodiment of the invention.
Figure 3:
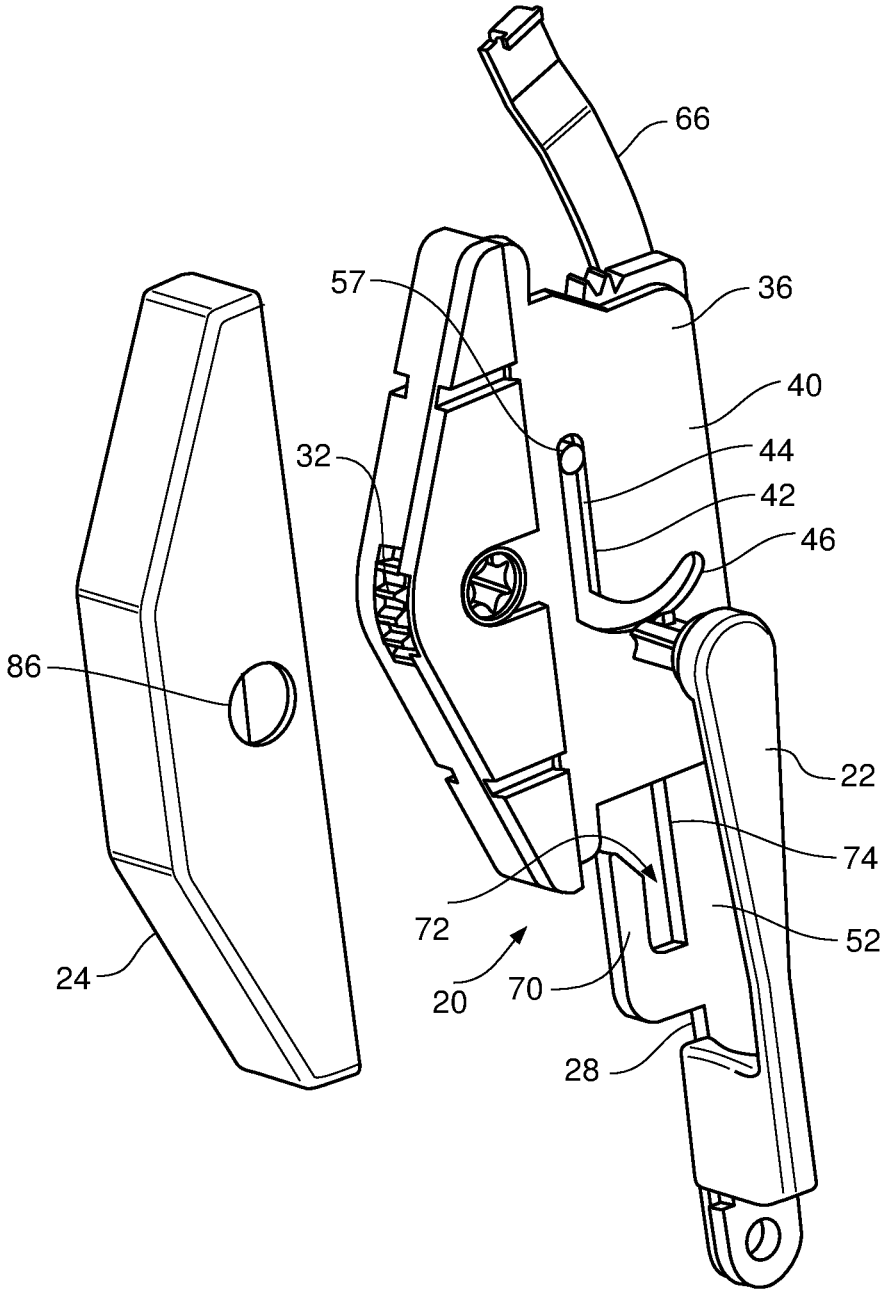
FIG. 3 is an exploded isometric view of the integrated window operator and lock FIG. 2.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION

In FIG. 1, there is depicted a typical casement window 10 with an integrated operator and lock 12 according to an embodiment of the invention. Casement window 10 generally includes frame 14 and sash 16. Frame 14 defines opening 18. Sash 16 is mounted to frame 14 with hinges (not depicted), and can be selectively swung to open and close opening 18.

Integrated operator and lock 12 is depicted in FIGS. 2-9. Integrated operator and lock 12 generally includes gear mechanism 20, handle 22, and cover 24. Gear mechanism 20 generally includes pinion gear assembly 26, and arm assembly 28. Pinion gear assembly 26 generally includes housing 30, and pinion gear 32. Housing 30 generally includes front portion 34 and rear portion 36. Pinion gear 32 is rotatably mounted in front portion 34. Rear portion 36 generally includes rearwardly projecting parallel walls 38, 40, each defining a guide slot 42 having a straight portion 44 and a curved portion 46, and with inwardly projecting guide pin 47 extending between parallel walls 38, 40. Pinion gear 32 defines aperture 48 having peripheral notches 50.

Arm assembly 28 generally includes arm 52, connector 54, and sash interface 56. Arm 52 may be formed as a single piece, and defines guide slot **54*a* in proximal end 55, and includes projecting pin 57. Peripheral edge 58 of proximal end 55 defines gear teeth 60 along straight rack portion 62 and curved gear portion 64. Tie bar interface 66 is pivotally coupled to proximal end 55 with pivot pin 68. Hook 70 defining slot 72 is provided along inner edge 74. Distal end 76 carries connector 54. Sash interface 56 generally includes track 81 and shoe 79. Shoe 79 is slidably coupled and engaged with track 81, and shoe 79 is horizontally pivotally coupled to arm 52 at distal end 76 via a pin 77 received in aperture 78. Shoe 79 generally includes two portions 83, 85, hinged together with vertical pin 87. Shoe 79 slides in track 81, and as it slides, pivots relative to arm 52 about pin 77, and shoe 79 portions 83, 85, pivot relative to each other about pin 87, which is oriented transverse to pin 77**.

Figure 9:
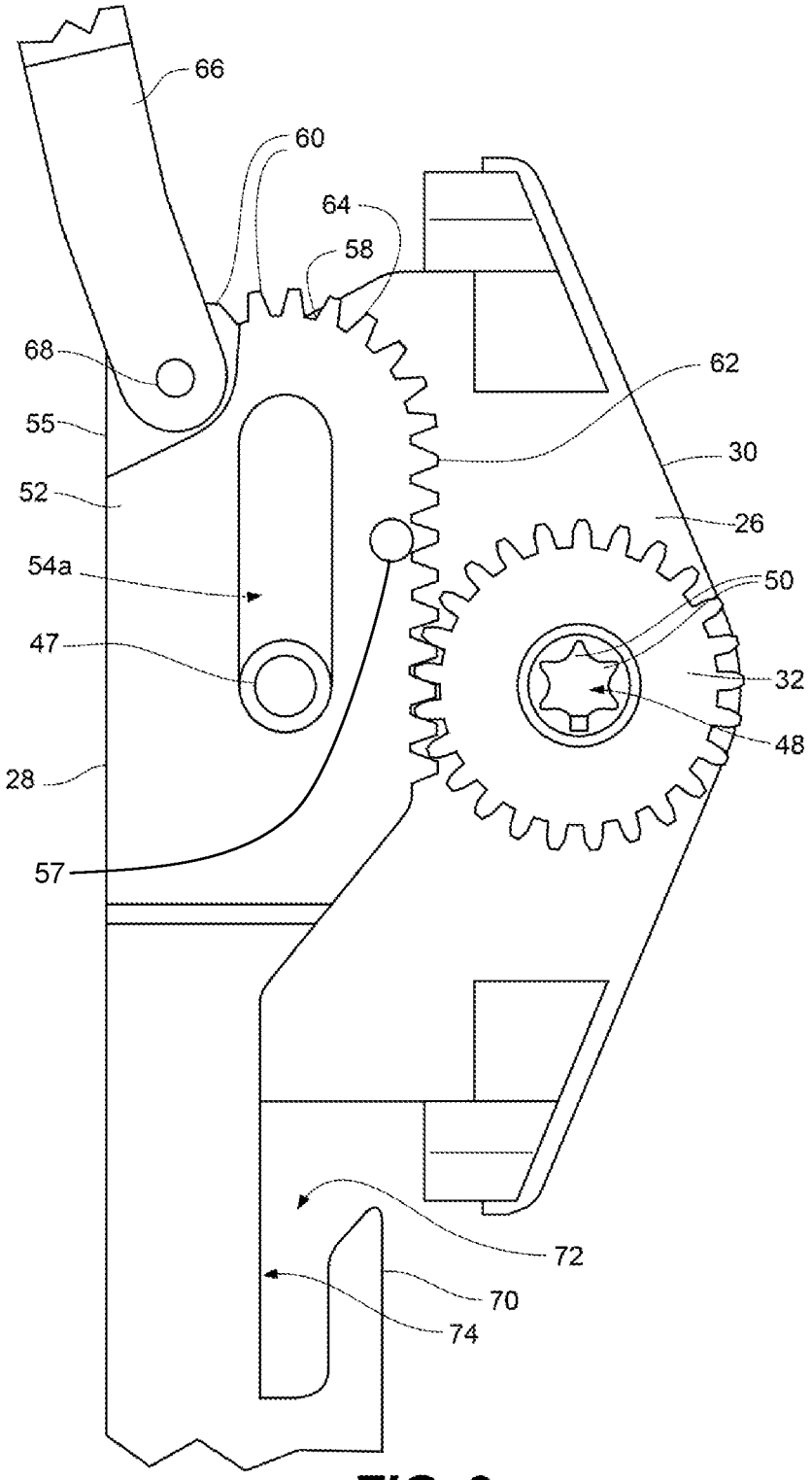
FIG. 9 is a side view, cross-sectional view of the window operator and lock of FIG. 2.

Arm 52 is slidably received in rear portion 36 of housing 30, with guide pin 47 extending through guide slot 54*a*, and projecting pins 57 received in guide slot 42. Pinion gear 32 is meshed with gear teeth 60 of straight rack portion 62 and curved gear portion 64 as depicted in FIG. 9.

Handle 22 generally includes arm portion 80, splined shaft 82, and gripping tab 84. Cover 24 defines apertures 86, and fits over front portion 34 of housing 30 with apertures 86 registered with aperture 48 of pinion gear 32.

Splined shaft 82 of handle 22 is received in aperture 48 of pinion gear 32 with splines 88 received in peripheral notches 50 of pinion gear 32 such that handle 22 is rotationally fixed to pinion gear 32. It will be appreciated that splined shaft 82 may be received in aperture 48 from either side, therefore enabling the mechanism to be installed on either the right or left side of a casement window, and thereby enabling right-handed or left-handed installation.

Figure 4:
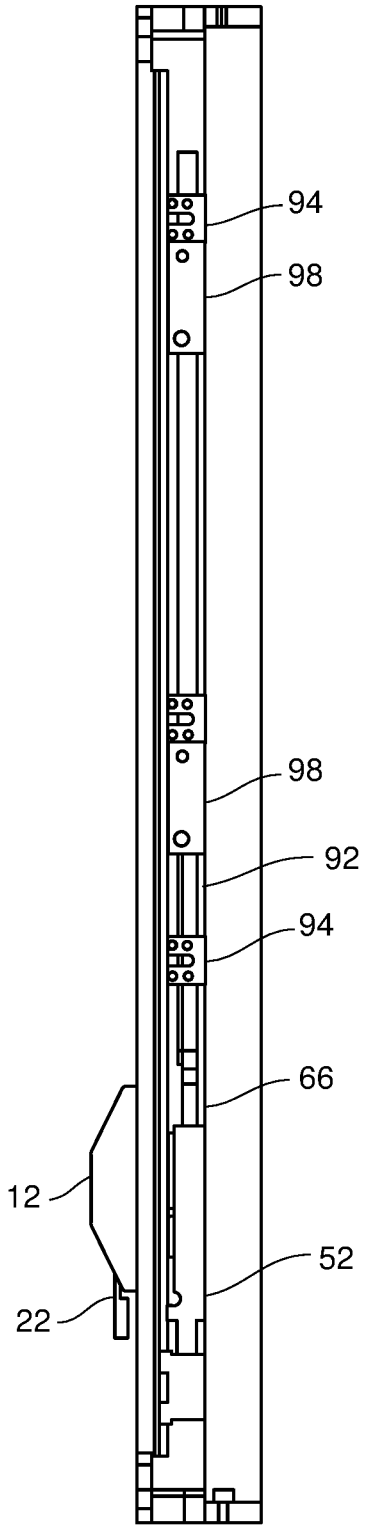
FIG. 4 is a side view of the window operator and lock of FIG. 2 with a tie-bar assembly depicting the mechanism in a locked, window closed position.
Figure 5:
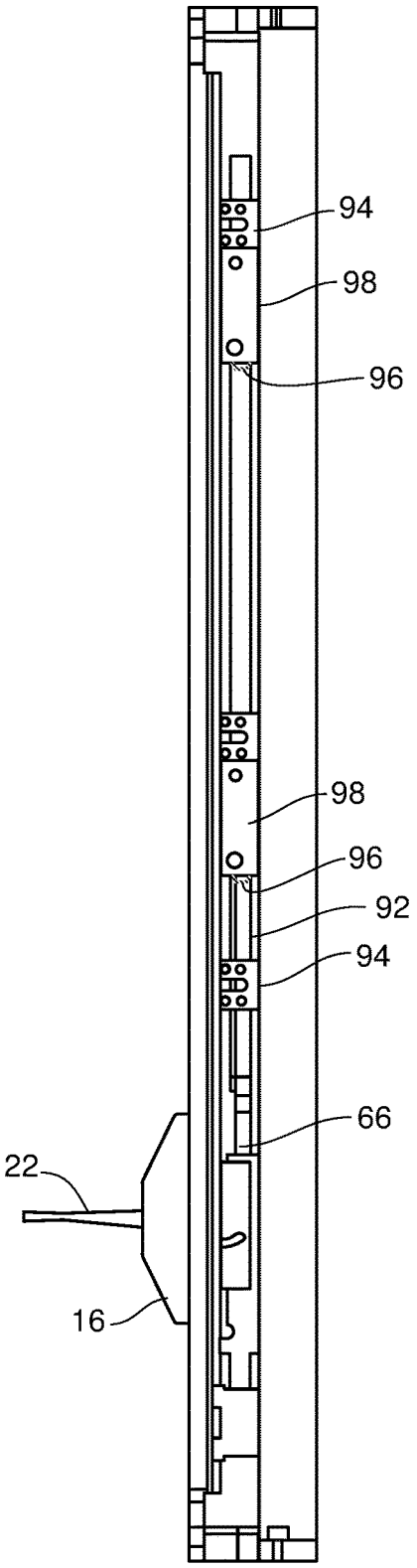
FIG. 5 is a side view of the window operator and lock of FIG. 2 with a tie-bar assembly depicting the mechanism in an unlocked, window closed position.
Figure 6:
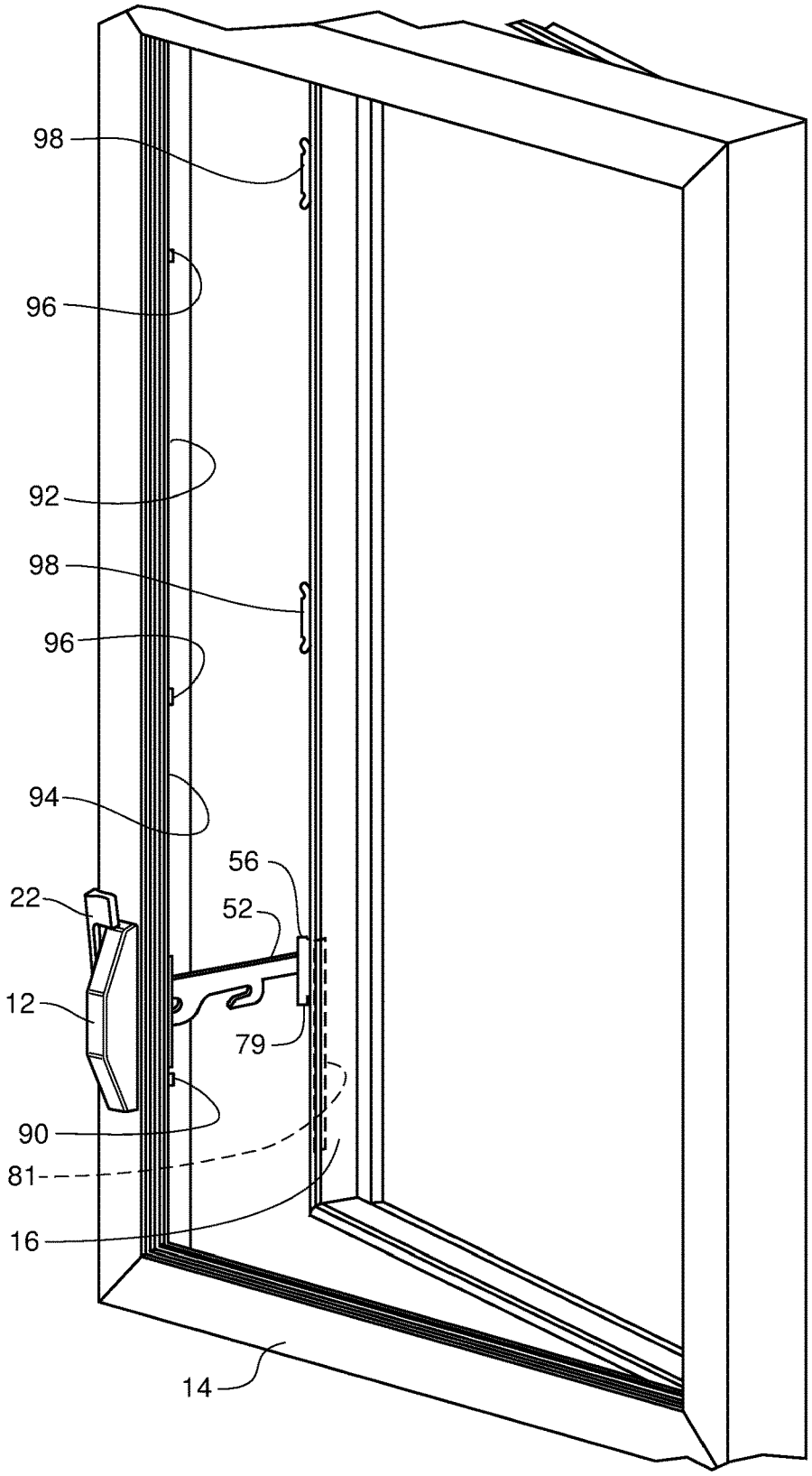
FIG. 6 is an isometric view of the window operator and lock of FIG. 2 with a casement window in an unlocked, window open position.

Tie bar interface 66 may be coupled so as to drive a tie-bar as typically used with multi-point casement window lock mechanisms, as is well-known in the art. As depicted in FIGS. 4-6, tie bar 92 is vertically slidable in guides 94. Lugs 96 are thereby engaged and disengaged from keepers 98 mounted to sash 16. An example of a known lock mechanism with tie-bar is disclosed in U.S. Pat. No. 7,452,014, said patent being owned by the owners of the present invention, and hereby fully incorporated herein by reference.

Figure 7:
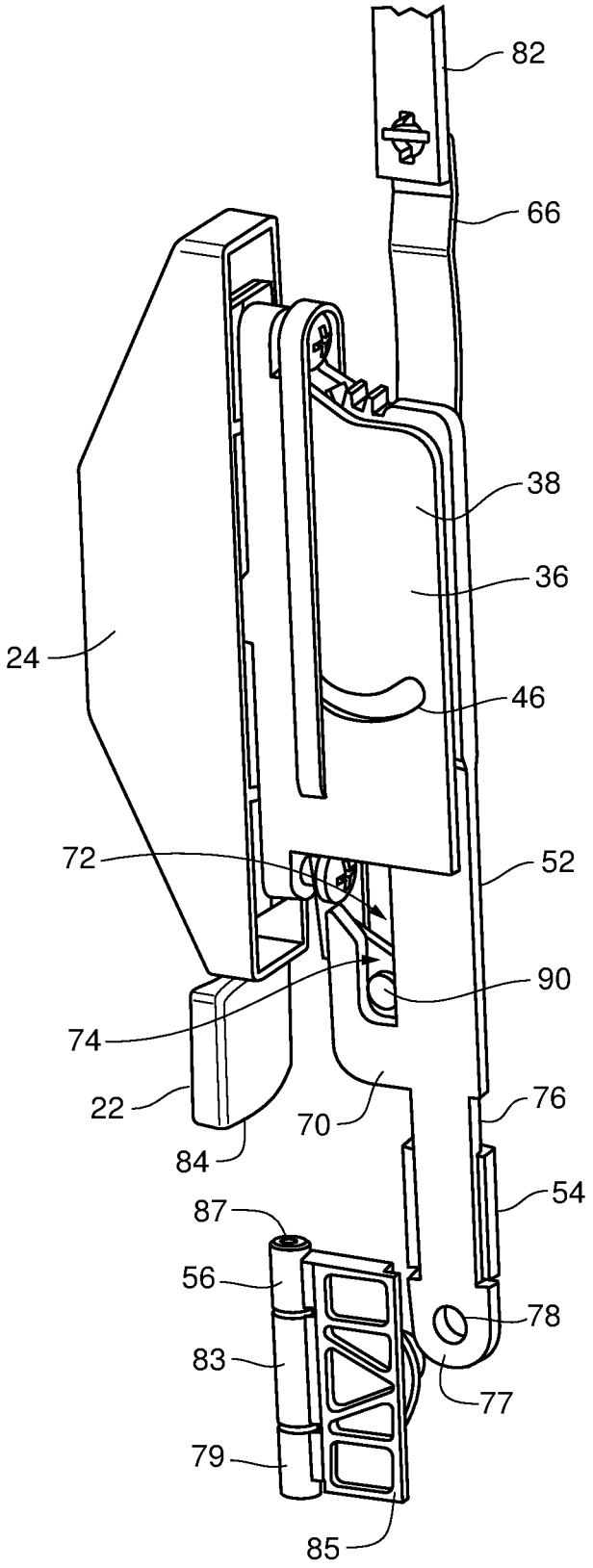
FIG. 7 is an isometric view of the window operator and lock of FIG. 2 in a locked, window closed position with a tie-bar attached.
Figure 8:
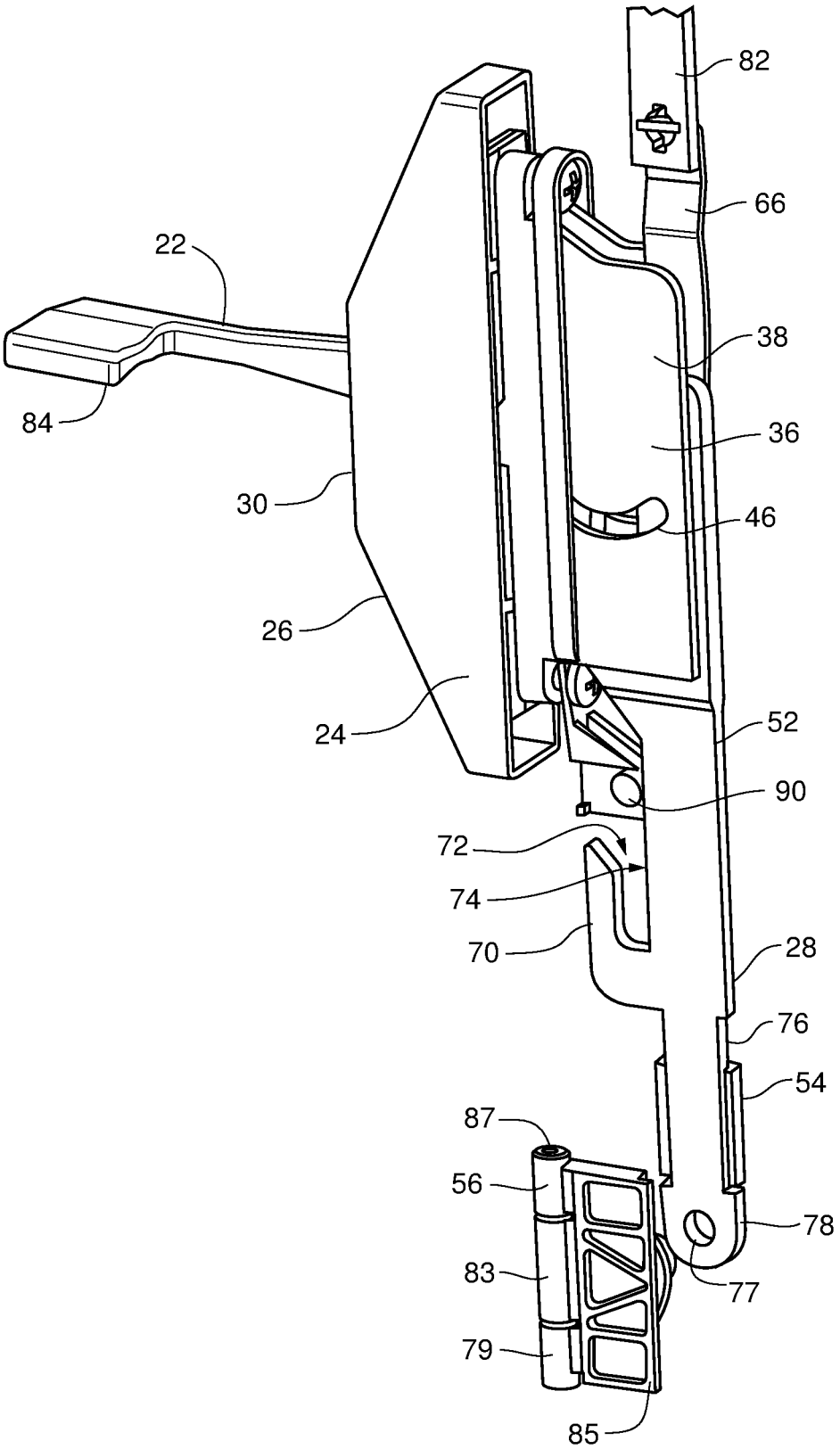
FIG. 8 is a isometric view of the window operator and lock of FIG. 2 in an unlocked, window closed position with a tie-bar attached.

In use, integrated operator and lock 12 is attached to frame 14 of casement window 10, and sash interface is attached to sash 16. As depicted in FIG. 7, with handle 22 in the downward orientation, lug 90 attached to frame 14 is engaged in slot 72 to lock sash 16 to frame 14 through the coupling of shoe 79 with track 81, and the meshing of pinion gear 32 with straight rack portion 62. As handle 22 is rotated upward to a mid-orientation as depicted in FIG. 8, pinion gear 32 rotates along rack portion 62, translating arm 52 downward and disengaging lug 90 from slot 72, thereby enabling sash 16 to be rotated outward without restriction from the engagement of lug 90 in slot 72. As handle 22 is rotated further upward, pinion gear 32 rotates along curved gear portion 64, causing arm 52 to swing outward. Shoe 79 slides upward in track 81, rotating about pin 77 relative to arm 52. At the same time, portions 83, 85, of shoe 79 pivot relative to each other about pin 87, so as to prevent binding as sash 16 rotates outwardly from frame 14. Through this operation, sash 16 is pushed to an open position by the swinging motion of arm 52 as depicted in FIG. 6. These operations are reversed to close and lock the window.

It will be appreciated that connector 54 may be a clip detachable from sash interface 56, so that arm 52 can be disconnected, thereby enabling emergency access or egress. When tie-bar interface 66 is coupled with a tie-bar assembly as previously described, window 10 may be provided with multiple locking points to improve security as depicted in FIGS. 4-6.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. An integrated casement window operator and lock, comprising:

a gear mechanism, the gear mechanism including a housing, a pinion gear rotatably mounted to the housing, and an arm assembly including an arm and a sash interface, the arm defining a rack portion and an adjacent arcuate gear portion, the arm slidably and rotatably mounted to the housing with the pinion gear engaged with the rack portion and the arcuate gear portion, the arm further defining a hook portion, the sash interface including a track and a shoe slidably coupled with the track, a distal end of the arm pivotally coupled with the shoe; and a handle directly fixed to the pinion gear, wherein with the housing of the gear mechanism adapted to be mounted on a frame of a casement window, and the track of the gear mechanism adapted to be mounted on a sash of the casement window, the handle is selectively movable to rotate the pinion gear such that the arm is shifted between a window locked position wherein the sash of the casement window is received in the frame of the casement window and the hook portion is engaged with a lug attached to the frame of the casement window so as to retain the sash in engagement with the frame, a window unlocked position wherein the arm is shifted relative to the housing such that the hook is free from engagement with the lug, and a sash open position wherein the arm is rotated relative to the housing urging the sash to be swung outward from the frame.

2. The integrated casement window operator and lock of claim 1, wherein the rack portion and the arcuate gear portion are defined on an edge of the arm.

3. The integrated casement window operator and lock of claim 1, wherein the housing defines a guide slot, and the arm has a pin, the pin slidably received in the guide slot.

4. The integrated casement window operator and lock of claim 3, wherein the guide slot has a straight portion and an arcuate portion, and wherein the guide pin slides in the arcuate portion of the guide slot as the sash moves between the window unlocked position and the sash open position.

5. The integrated casement window operator and lock of claim 1, wherein the arm is operably coupled to a tie bar slidably mounted to the frame of the casement window.

6. The integrated casement window operator and lock of claim 5, wherein the tie bar includes at least one lug, and at least one corresponding keeper is attached to the sash, the tie bar being selectively shiftable with the handle such that the at least one lug of the tie bar is engaged with the at least one corresponding keeper in the window locked position, and the at least one lug of the tie bar is free from the at least one corresponding keeper in the window unlocked position.

7. The integrated casement window operator and lock of claim 1, further comprising a cover.

8. The integrated casement window operator and lock of claim 1, wherein the handle is engageable with the pinion gear in at least two different orientations so as to accommodate left-handed and right-handed mounting.

9. The integrated casement window operator and lock of claim 1, wherein the window locked position corresponds to a first position of the handle, the window unlocked position corresponds to a second position of the handle, and the sash open position corresponds to a third position of the handle.

10. A casement window, comprising:

a frame defining an opening;

a sash received in the frame and hinged to the frame to selectively close the opening; and a window operator and lock, the window operator and lock comprising:

a gear mechanism, the gear mechanism including a housing, a pinion gear rotatably mounted to the housing, and an arm assembly including an arm and a sash interface, the arm defining a rack portion and an adjacent arcuate gear portion, the arm slidably and rotatably mounted to the housing with the pinion gear engaged with the rack portion and the arcuate gear portion, the arm further defining a hook portion, the sash interface including a track and a shoe slidably coupled with the track, a distal end of the arm pivotally coupled with the shoe; and a handle directly fixed to the pinion gear, wherein the housing of the gear mechanism is mounted to the frame of the casement window, and the track of the gear mechanism is mounted to the sash of the casement window, the handle is selectively movable to rotate the pinion gear such that the arm is shifted between a window locked position wherein the sash of the casement window is received in the frame of the casement window to close the opening and the hook portion is engaged with a lug attached to the frame of the casement window so as to retain the sash in engagement with the frame, a window unlocked position wherein the arm is shifted relative to the housing such that the hook is free from engagement with the lug, and a sash open position wherein the arm is rotated relative to the housing urging the sash to be swung outward from the frame.

11. The casement window of claim 10, wherein the rack portion and the arcuate gear portion are defined on an edge of the arm.

12. The casement window of claim 10, wherein the housing defines a guide slot, and the arm has a pin, the pin slidably received in the guide slot.

13. The casement window of claim 12, wherein the guide slot has a straight portion and an arcuate portion, and wherein the guide pin slides in the arcuate portion of the guide slot as the sash moves between the window unlocked position and the sash open position.

14. The casement window of claim 10, wherein the arm is operably coupled to a tie bar slidably mounted to the frame of the casement window.

15. The casement window of claim 14, wherein the tie bar includes at least one lug, and at least one corresponding keeper is attached to the sash, the tie bar being selectively shiftable with the handle such that the at least one lug of the tie bar is engaged with the at least one corresponding keeper in the window locked position, and the at least one lug of the tie bar is free from the at least one corresponding keeper in the window unlocked position.

16. The casement window of claim 10, further comprising a cover.

17. The casement window of claim 10, wherein the handle is engageable with the pinion gear in at least two different orientations, so as to accommodate left-handed and right-handed mounting.

18. The casement window of claim 10, wherein the window locked position corresponds to a first position of the handle, the window unlocked position corresponds to a second position of the handle, and the sash open position corresponds to a third position of the handle.

* * * * *